US007705865B2

(12) United States Patent
Hsu et al.

(10) Patent No.: US 7,705,865 B2
(45) Date of Patent: Apr. 27, 2010

(54) DISPLAY PANEL DRIVING DEVICE AND DRIVING METHOD THEREOF

(75) Inventors: Tien-Chu Hsu, Kaohsiung (TW); Chih-Liang Wu, Chiayi County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 421 days.

(21) Appl. No.: 11/460,609

(22) Filed: Jul. 27, 2006

(65) Prior Publication Data

US 2008/0024525 A1 Jan. 31, 2008

(51) Int. Cl.
*G09G 3/36* (2006.01)
*G09G 5/10* (2006.01)

(52) U.S. Cl. ..... 345/690; 345/88; 345/89

(58) Field of Classification Search ..... 345/690, 345/88, 89

See application file for complete search history.

(56) References Cited

U.S. PATENT DOCUMENTS 6,919,691 B2 7/2005 Mizukoshi et al.
7,312,776 B2 * 12/2007 Bu ..... 345/88
7,403,182 B2 * 7/2008 Lee ..... 345/89
2003/0080931 A1 * 5/2003 Chen et al. ..... 345/88
2005/0007393 A1 1/2005 Akai et al.
2005/0190135 A1 * 9/2005 Chen et al. ..... 345/88
2006/0114205 A1 6/2006 Shen et al.

FOREIGN PATENT DOCUMENTS

JP 2004-138831 5/2004

* cited by examiner

*Primary Examiner*—Amr Awad
*Assistant Examiner*—Randal Willis
(74) *Attorney, Agent, or Firm*—Jianq Chyun IP Office

(57) ABSTRACT

The present invention discloses a display panel driving device and a driving method thereof, wherein the display panel driving device includes a plurality of mapping table units and a source driver. The mapping table units receive a plurality of primary color signals respectively, and convert grayscale levels of the primary colors into a plurality of mapping grayscale level values corresponding to a single gamma curve according to the grayscale level mapping relation between the single gamma curve and a plurality of primary color gamma curves. The source driver is electrically connected to the mapping table units to receive the mapping grayscale level values generated by the mapping table units, and convert the mapping grayscale level values into a plurality of driving voltages according to the relation between grayscale levels and voltages of the single gamma curve for inputting the driving voltages into a display panel.

18 Claims, 8 Drawing Sheets

DISPLAY PANEL DRIVING DEVICE AND DRIVING METHOD THEREOF

BACKGROUND OF THE INVENTION

1. Field of Invention

The present invention relates to a display panel driving device and a driving method thereof. More particularly, the present invention relates to a display panel driving device using a single gamma curve and a driving method thereof.

2. Description of Related Art

Currently, in order to improve display quality and provide grayscale levels of each primary color that can be accurately sensed by the eye, gamma curves are usually used to relate the grayscale levels of each primary color to driving voltages required by display devices. FIG. 1 is a curve diagram showing gamma curves of each primary color of an organic light-emitting diode (OLED), wherein the horizontal axis stands for grayscale level and the vertical axis stands for voltage. A red light gamma curve 101 almost overlaps a blue light gamma curve 102, which are shown by one common curve in FIG. 1, while a green light curve 103 is apparently different from the curves 101 and 102. FIG. 2 shows a circuit block diagram of a conventional OLED display 200. The OLED display 200 comprises a source driver 21, an OLED panel 22 and a gate driver 23. The source driver 21 receives data and three groups of gamma voltages of red light, green light and blue light, wherein the three groups of gamma voltages are sampled values from the red, green and blue primary color gamma curves, respectively. The source driver 21 converts grayscale levels of three primary colors in the input data into three groups of driving voltages with reference to the red light, green light and blue light gamma voltages, and then outputs the three groups of driving voltages to the OLED panel 22. The OLED panel 22 is sequentially scanned by the gate driver 23 controlled by the input signal. As three groups of gamma voltages are needed, the complexity of the circuit is greatly increased and the development time of the product is prolonged so that there is a risk of revealing secrets during the long product research/development process.

FIG. 3 shows a circuit block diagram of another conventional OLED display 300. The OLED display 300 comprises a source driver 31, an OLED panel 32 and a gate driver 33. Data are input into the source driver 31 by an external device (not shown), and the grayscale levels of red light, green light and blue light in the input data are converted into driving voltages by the source driver 31 according to a single group of gamma voltages of a single gamma curve and then the driving voltages are input into the OLED panel 32. The gate driver 33 receives a control signal to sequentially scan the OLED panel 32. Referring to both FIGS. 1 and 3, as the source driver 31 generates driving voltages of each primary color according to a single gamma curve, for example, assume the single gamma curve is the red light gamma curve 101, the driving voltage may be too high for the green light when the input data represents an all white frame, thereby resulting in a greenish frame. On the other hand, if the single gamma curve is the green light gamma curve 103, the driving voltages are apparently insufficient for the red light and the blue light when the input data represents an all white frame, also resulting in a greenish frame.

SUMMARY OF THE INVENTION

An object of the present invention is to provide a display panel driving device to save the cost, reduce the circuit complexity, shorten the research/development time and facilitate the test and verification of display panels.

Another object of the present invention is to provide a method for driving a display panel, which can not only reduce the circuit complexity and cost of display panels but also display colors accurately without deviation.

The present invention provides a display panel driving device comprising a plurality of mapping table units and a source driver. The plurality of mapping table units receives a plurality of primary color signals respectively, and then converts grayscale levels of the plurality of primary colors into a plurality of mapping grayscale levels corresponding to a single gamma curve according to the grayscale level mapping relation between the single gamma curve and a plurality of primary color gamma curves. The source driver is electrically connected to a plurality of mapping table units to receive mapping grayscale level values generated by the plurality of mapping table units, and convert the plurality of mapping grayscale level values into a plurality of driving voltages according to the relation between grayscale levels and voltages of the single gamma curve, so as to input the plurality of driving voltages into a display panel.

In an embodiment of the present invention, each of the above mapping grayscale level values includes an integral part and a fractional part, and the aforementioned display panel driving device further comprises a plurality of dithering units respectively electrically connected to a plurality of corresponding mapping table units to receive a plurality of mapping grayscale level values for performing a dithering mechanism according to the above-mentioned fractional part. As such, the plurality of mapping grayscale level values is converted into a plurality of corresponding grayscale level combination values input into the source driver. The source driver converts the plurality of grayscale level combination values into a plurality of combination driving voltages according to the relation between grayscale levels and voltages of the single gamma curve, so as to input the plurality of driving voltages into the display panel. The voltage range of the single gamma curve comprises all of the driving voltages of a plurality of primary color gamma curves. Moreover, the aforementioned plurality of mapping table units respectively converts grayscale levels of the plurality of primary color gamma curves into a plurality of mapping grayscale level values of the same driving voltages in the single gamma curve.

The present invention provides another method for driving a display panel corresponding to the above display panel driving device, and the main steps are as follows. First, a plurality of primary color signals is received. The grayscale levels of the plurality of primary color signals are converted into a plurality of mapping grayscale level values corresponding to a single gamma curve according to the grayscale level mapping relation between the single gamma curve and a plurality of primary color gamma curves. Afterward, the plurality of mapping grayscale level values are converted into a plurality of driving voltages according to the relation between grayscale levels and voltages of the single gamma curve, and the foregoing plurality of driving voltages are then input into a display panel.

The present invention employs a structure of using a plurality of mapping tables and a dithering mechanism and using a single gamma curve to convert grayscale levels into corresponding driving voltages instead of requiring a plurality of gamma voltages as in the conventional art. Therefore, the present invention can save cost, reduce the circuit complexity, shorten the research/development time and facilitate the test and verification of display panels. Furthermore, the mapping table mechanism of the present invention can convert grayscale levels of a primary color gamma curve into correct diving voltages, such that accurate colors can be displayed without deviation. If the present invention is applied to an OLED display panel, a source driver of a thin film transistor liquid crystal display panel can be used to directly replace the source driver of the OLED display panel, so as to reduce the circuit complexity and cost of the OLED display panel.

In order to make the aforementioned and other objects, features and advantages of the present invention more comprehensible, preferred embodiments accompanied with figures are described in detail below.

DESCRIPTION OF EMBODIMENTS

The display panel driving device and the driving method thereof according to the present invention only utilize a single gamma curve to convert grayscale levels into corresponding driving voltages. The design principle of the single gamma curve contains the driving voltage range of a plurality of primary color signals. Each of the plurality of primary color signals, for example, a red light signal, a blue light signal and a green light signal, has an exclusive primary color gamma curve due to differences in the correcting mechanism of each color light. In order to display all primary grayscale levels accurately by a single gamma curve, the present invention makes grayscale levels of each primary color gamma curve correspond to mapping grayscale levels of the same driving voltage on the single gamma curve via mapping table units. The usable grayscale levels of the primary colors may be greatly reduced due to the adoption of a single gamma curve. To solve the problem, a dithering mechanism can be used to combine the original usable grayscale levels into more grayscale levels so as to improve the display quality. As such, the source driver can output the driving voltage corresponding to the single gamma curve with reference to a group of gamma voltages.

Figure 1:
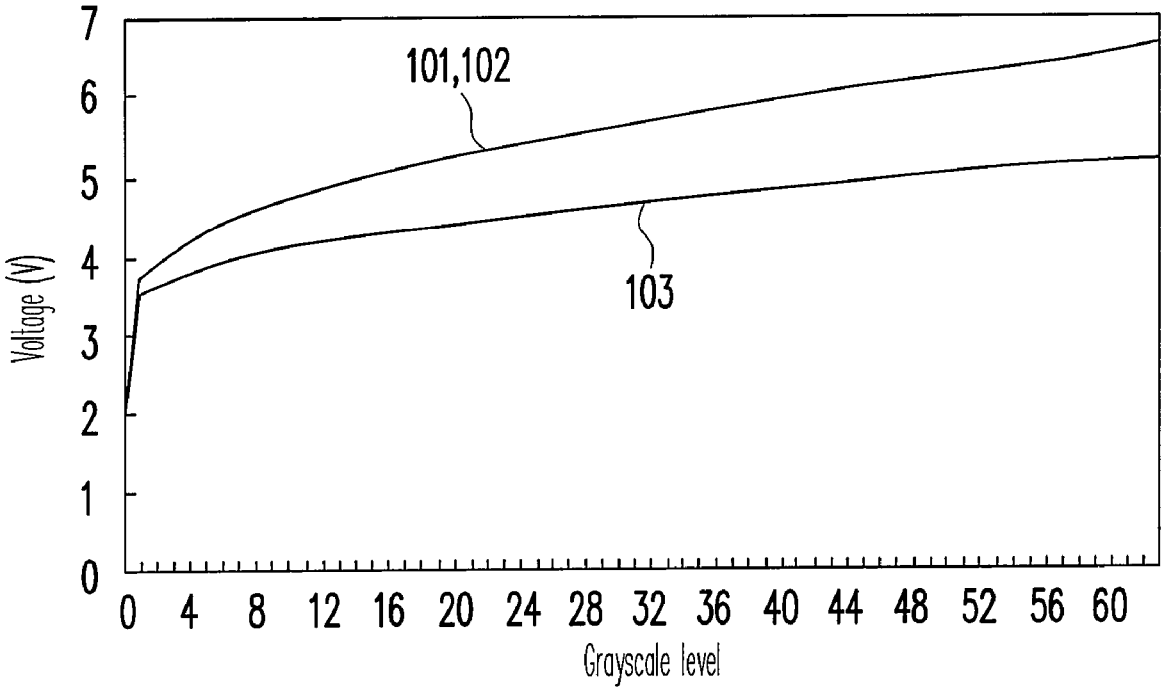
FIG. 1 shows a curve diagram of gamma curves of each primary color of an OLED.
Figure 2:
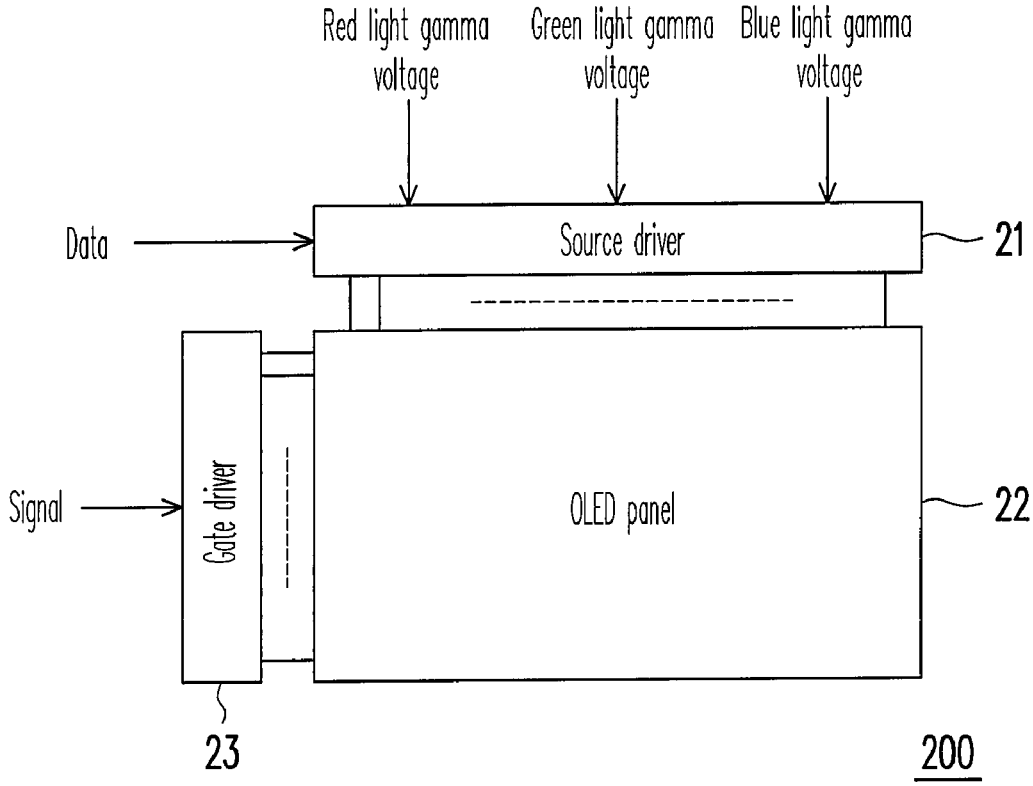
FIG. 2 (PRIOR ART)
FIG. 2 shows a circuit block diagram of a conventional OLED display.
Figure 3:
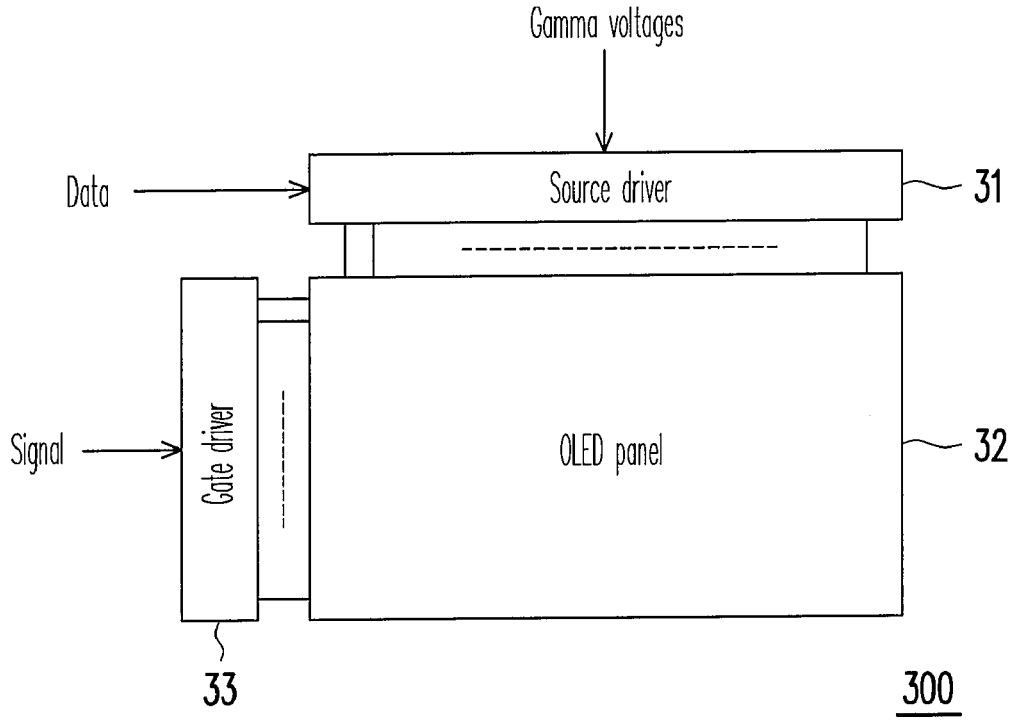
FIG. 3 (PRIOR ART)
FIG. 3 shows a circuit block diagram of another conventional OLED display.
Figure 4:
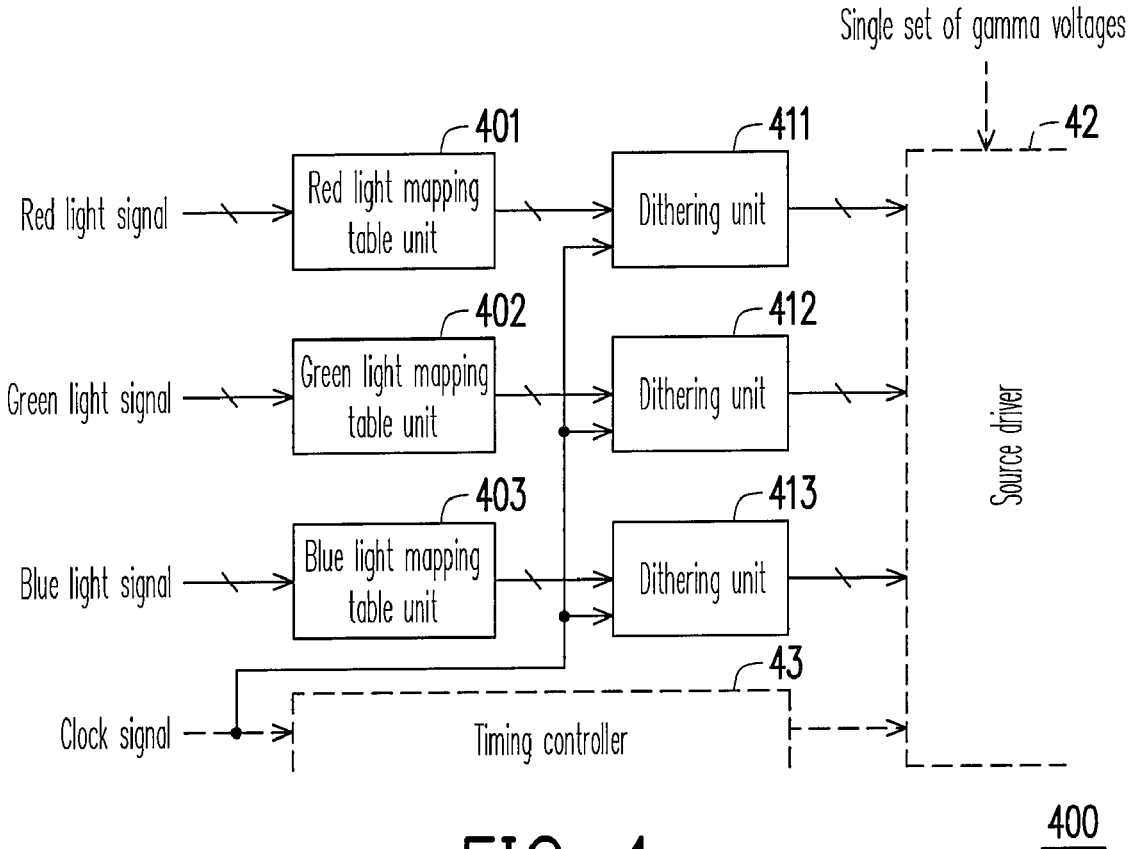
FIG. 4 shows a circuit block diagram of the OLED display panel driving device 400 according to an embodiment of the present invention.
Figure 5A:
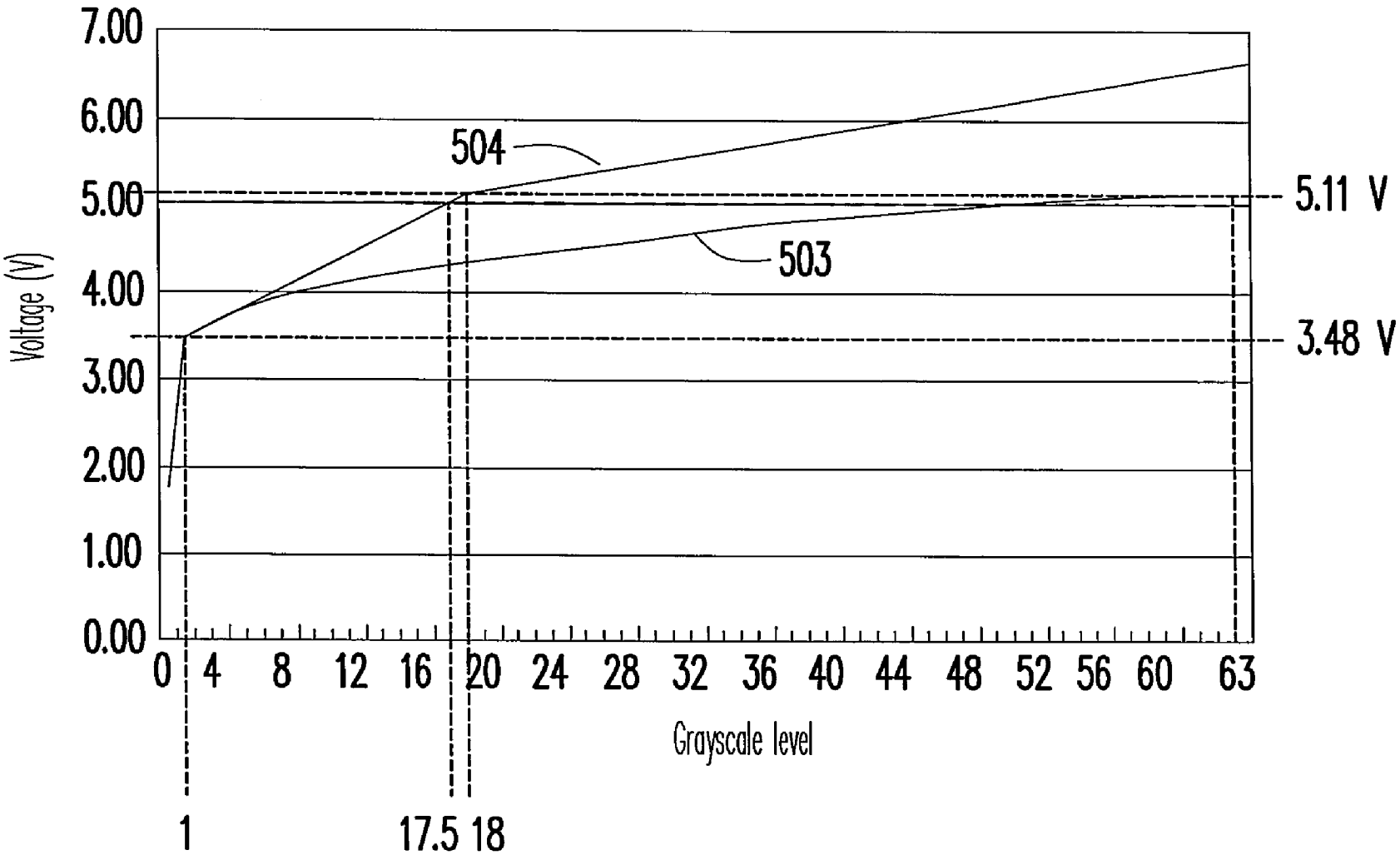
FIG. 5A shows a curve diagram illustrating the design principle of the green light mapping table unit 402.

FIG. 4 shows a circuit block diagram of an LED driving device 400 according to an embodiment of the present invention. The OLED driving device 400 comprises a red light mapping table unit 401, a green light mapping table unit 402, a blue light mapping table unit 403, dithering units 411, 412 and 413, a source driver 42 and a timing controller 43. FIG. 5A, taking the green light as an example, shows a curve diagram of the design principle of the green light mapping table unit 402, wherein the vertical axis stands for voltage and the horizontal axis stands for grayscale level. A single gamma curve 504 overlaps a green light gamma curve 503 at grayscale levels 0~1, both the grayscale level 1 of a single gamma grayscale level and the grayscale level 1 of the green light gamma curve correspond to a voltage 3.48 V, and both the grayscale level 18 of the single gamma color and the grayscale level 63 of the green light gamma curve correspond to a voltage 5.11 V, so the grayscale levels 1~18 of the single gamma curve comprise all driving voltages of the grayscale levels 1~63 of the green light gamma.

When the green light mapping unit 402 receives a certain grayscale level value of the green light signal, it will convert the received grayscale level value into a mapping grayscale level value of the single gamma curve 504. The driving voltage corresponding to a grayscale level value of the green light signal on the green light gamma curve 503 must be identical to the driving voltage corresponding to a mapping grayscale level value on the single gamma curve 504, so as to display an accurate color. For example, when being displayed, a grayscale level 61 of the green light signal is mapped to a mapping grayscale level 17.5 on the single gamma curve of the same driving voltage by the mapping table unit 402. An ordinary source driver does not accept the fractional parts, and if only the integral parts are adopted, the original green light grayscale levels 1~63 will be compressed into grayscale levels 1~18 of the single gamma curve, resulting in damage to the frame quality. To solve this problem, the dithering unit 412 of the present invention can use a dithering algorithm to compensate the loss of the fractional part via a combination of an integral number of grayscale levels, so as to increase the grayscale level gradation of the green light. The principles of the red light and blue light mapping units are the same as that of the green light mapping unit.

In FIG. 4, the red light signal, the green light signal and the blue light signal are input into the red light mapping table unit 401, green light mapping table unit 402 and blue light mapping table 403 respectively, so as to convert the original grayscale levels into mapping grayscale levels of the single gamma curve. Then, the mapping grayscale levels are dithered into grayscale level combination values by the dithering modulation mechanism and input into the source driver 42. The source driver 42 receives a grayscale level combination value of red light, green light and blue light, and outputs driving voltages corresponding to the foregoing grayscale levels according to gamma voltages of the single gamma curve. Furthermore, a clock signal is input into the dithering units 411~413 to perform a time dithering, and the clock signal is also input into a timing controller 43, so as to control the source driver 42 via the timing controller 43 to output the driving voltages sequentially.

Figure 5B:
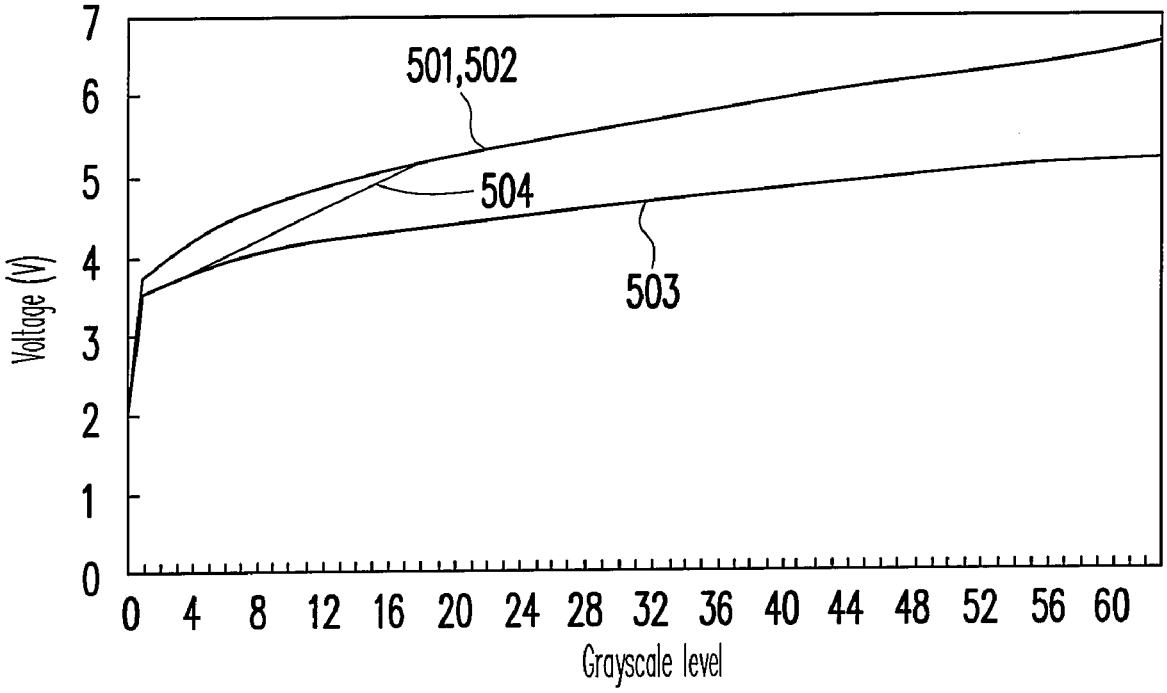
FIG. 5B shows a waveform chart of the single gamma curve 504 of the source driver 42.

FIG. 5B shows a curve diagram of the single gamma curve 504 used by the source driver 42, wherein the horizontal axis stands for grayscale level and the vertical axis stands for voltage. The source driver 42 converts grayscale levels of the red light, green light and blue light signals into corresponding driving voltages by using gamma voltages from the single gamma curve. The single gamma curve 504 lies between a red light gamma curve 501, a green light gamma curve 502 and a green light gamma curve 503, and overlaps the red light, green light and blue light gamma curves at grayscale levels 0~1 while only overlaps the red light and the blue light gamma curves after the grayscale level 18. In order to achieve an optimal convert effect, the single gamma curve 504 after the grayscale level 18 is defined as the red light gamma curve 501 and the blue light gamma curve 502. The voltage range of the single gamma curve 504 at grayscale levels 1~18 contains all voltage ranges of the green light gamma curve 503. To display all of the colors, the single gamma curve 504 must contain driving voltages in all grayscale level ranges of the red light, blue light and green light signals. Therefore, the single gamma curve 504 can be any progressive curve to contain driving voltages in all grayscale level ranges of the red light gamma curve 501, blue light gamma curve 502 and green light gamma curve 503.

Figure 6A:
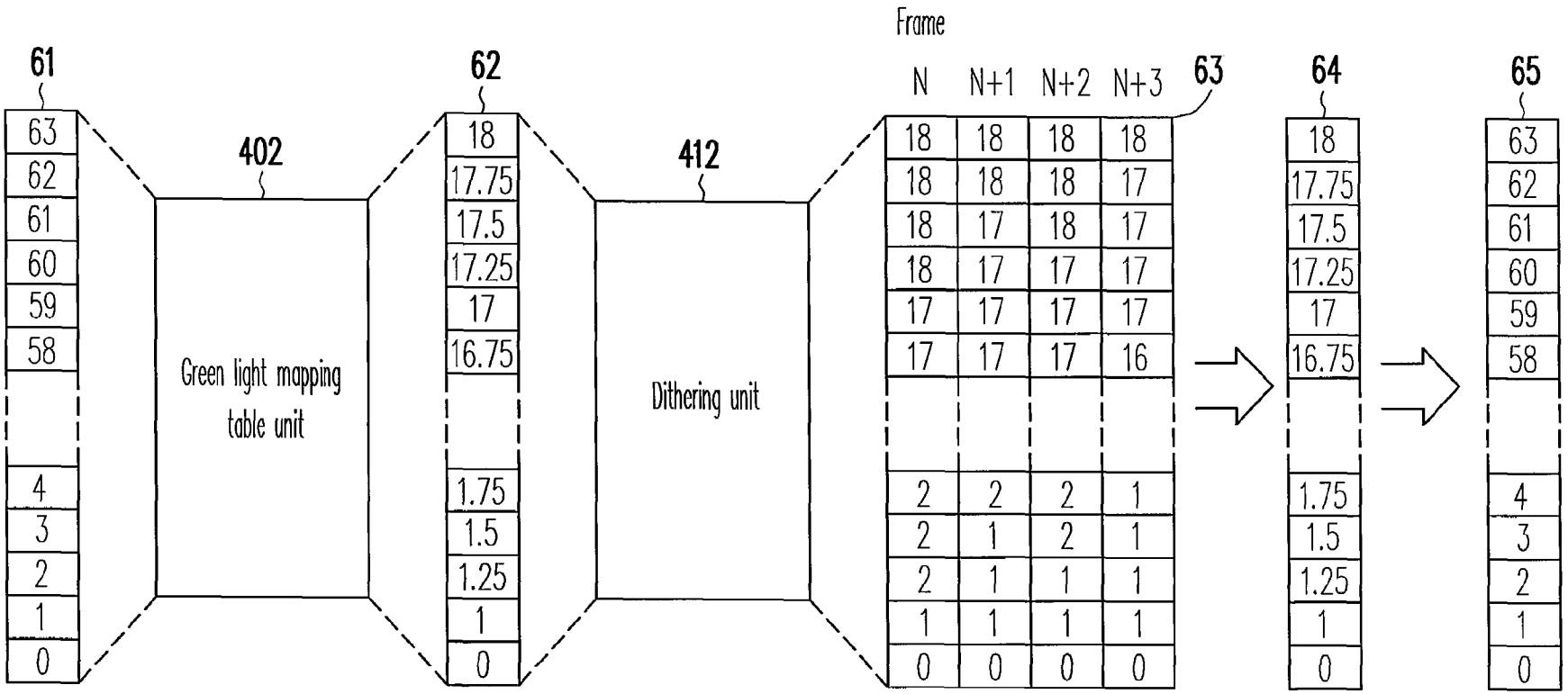
FIG. 6A shows a distribution graph of the green light grayscale levels through the green light mapping table unit 402 and the dithering unit 412.

FIG. 6A shows a distribution graph of the green light grayscale levels passing through the green light mapping table unit 402 and the dithering unit 412. 61 refers to a grayscale level distribution table of the green light signal with grayscale levels 0~63, and is converted into a grayscale level grayscale level distribution table 62 after the green light signal passes through the green light mapping table unit 402. The grayscale level distribution table 62 has grayscale levels 0~18, and this determination process can refer to FIGS. 5B and 6A at the same time. In the present embodiment, the grayscale level 61 of the green light gamma curve 503 has the same voltage as the grayscale level 17.5 of the single gamma curve 504, so the grayscale level 61 of the grayscale level distribution table 61 corresponds to the value of the grayscale level 17.5 of the grayscale level distribution table 62. However, due to the design of the source driver 42 to receive integral input values, a grayscale level 17 and the grayscale level 18 are output as a combination according to timing via the dithering algorithm. In a grayscale level distribution table 63, a dithering manner is determined by the fractional part 0.5 of the grayscale level 17.5, so that a grayscale level 18 is output at frames N and N+3 N is a positive integer), a grayscale level 17 is output at frames N+1 and N+3, and the average of the output grayscale levels is equivalent to a grayscale level value 17.5 of the grayscale level distribution table 64. Thereby, the display effect of the grayscale level value 61 of a grayscale level distribution table 65 can be achieved. The distributions of the red light and blue light grayscale levels in the present embodiment is similar to the green light grayscale levels in FIG. 6A, so they will not be described in detain herein.

Figure 6B:
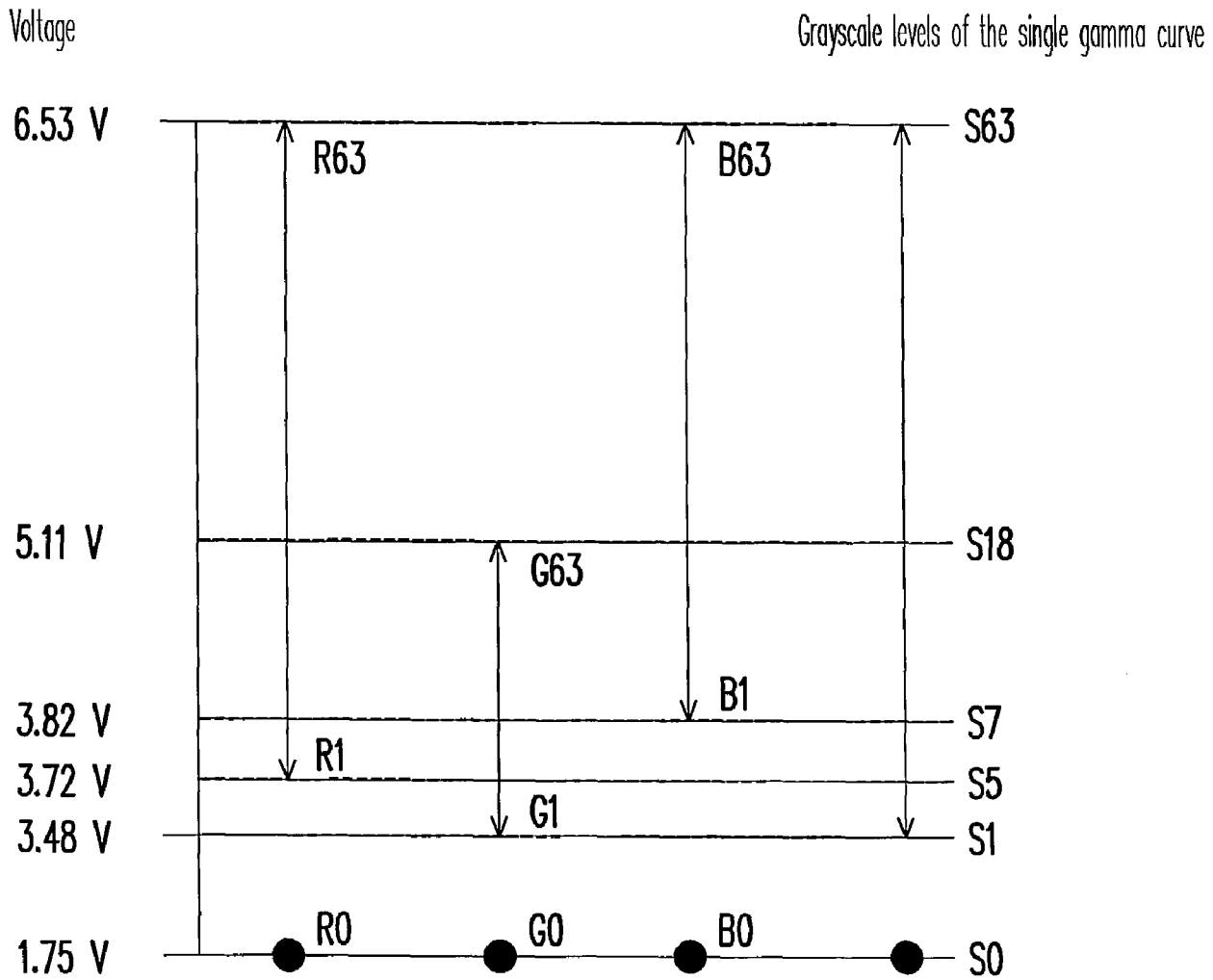
FIG. 6B shows a distribution graph of the grayscale level values of the single gamma curve 504 according to an embodiment of the present invention.

FIG. 6B shows a distribution graph of the values of the single gamma curve 504 according to an embodiment of the present invention. To facilitate representing grayscale levels of each color light, the red light, green light, blue light and single gamma grayscale levels are referred to as R0~R63, G0~G63, B0~B63 and S0~S63 respectively. The grayscale levels R0, G0, B0 and S1 have the same initial value. The green light grayscale level G1 and the single gamma grayscale level S1 have the same corresponding voltage value of 3.48 V. The red light grayscale level R1 and the single gamma grayscale level S5 have the same corresponding voltage value of 3.72 V. The blue light grayscale level B1 and the single gamma grayscale level S7 have the same corresponding voltage value of 3.82 V. The green light grayscale level G63 and the single gamma color S18 have the same corresponding voltage value of 5.11 V. The red light grayscale level R63, the blue light grayscale level B63, and the single gamma grayscale level S63 have the same corresponding voltage value of 6.53 V. Consequently the voltage range of the single gamma grayscale level can cover all voltage ranges of the red light gamma levels R0~R63, green light gamma grayscale levels G0~G63 and blue light gamma grayscale level B0~B63, thereby enabling the single gamma curve to display all grayscale levels of the three primary colors.

Figure 7A:
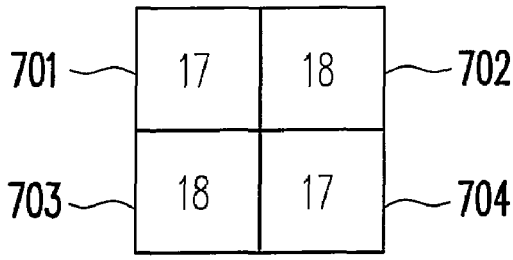
FIG. 7A shows a consecutive grid chart of an example of spatial dithering for pixels of a display panel driving device according to an embodiment of the present invention.

In FIG. 6A, according to the present embodiment, dithering is performed by temporal dithering, and the dithering mechanism can also be performed by spatial dithering or by spatial and temporal dithering. FIG. 7A is an example of spatial dithering for the display panel driving device according to an embodiment of the present invention. Pixels 701, 702, 703 and 704 adjacent to each other spatially form one unit and correspond to grayscale levels 17, 18, 18, and 17 respectively, and the average effect sensed by human eyes is 17.5. The spatial dithering is not limited to take four adjacent pixels as one unit, and the unit can be consisted of any amount of adjacent pixels.

Figure 7B:
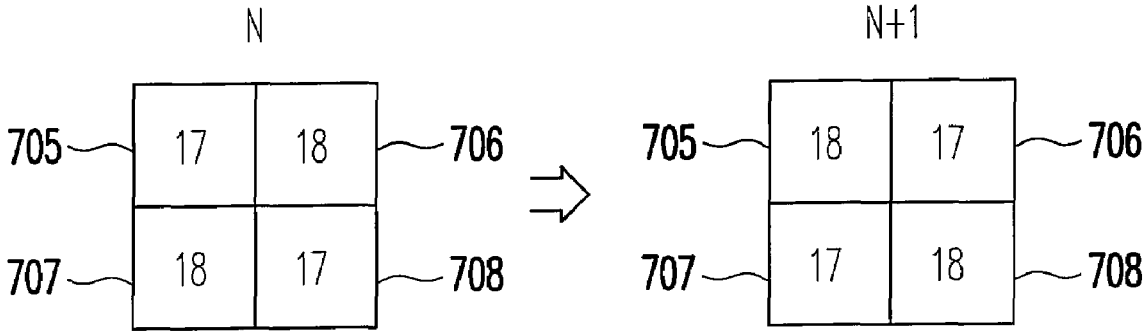
FIG. 7B shows a consecutive grid chart of an example of spatial and temporal dithering for pixels in a display panel of a display panel driving device according to an embodiment of the present invention.

FIG. 7B shows an example of spatial and temporal dithering for the display panel driving device according to an embodiment of the present invention. At the frame N, adjacent pixels 705, 706, 707, 708 correspond to grayscale levels 17, 18, 18 and 17, while at the frame N+1, the corresponding grayscale levels are 18, 17, 17, 18, and the average effect sensed by human eyes is 17.5. The above-mentioned spatial dithering and time dithering can be varied at random, as long as the average value of the spatial/time grayscale level is 17.5.

It is apparent to those skilled in this art that the display panel driving device of the present invention is not limited to receiving signals of three primary colors of red, blue and green but can be applied to various primary color signals constituting a display image, and is also not limited to the OLED display panel but can be applied to other display panels requiring a plurality of gamma curves.

Figure 8:
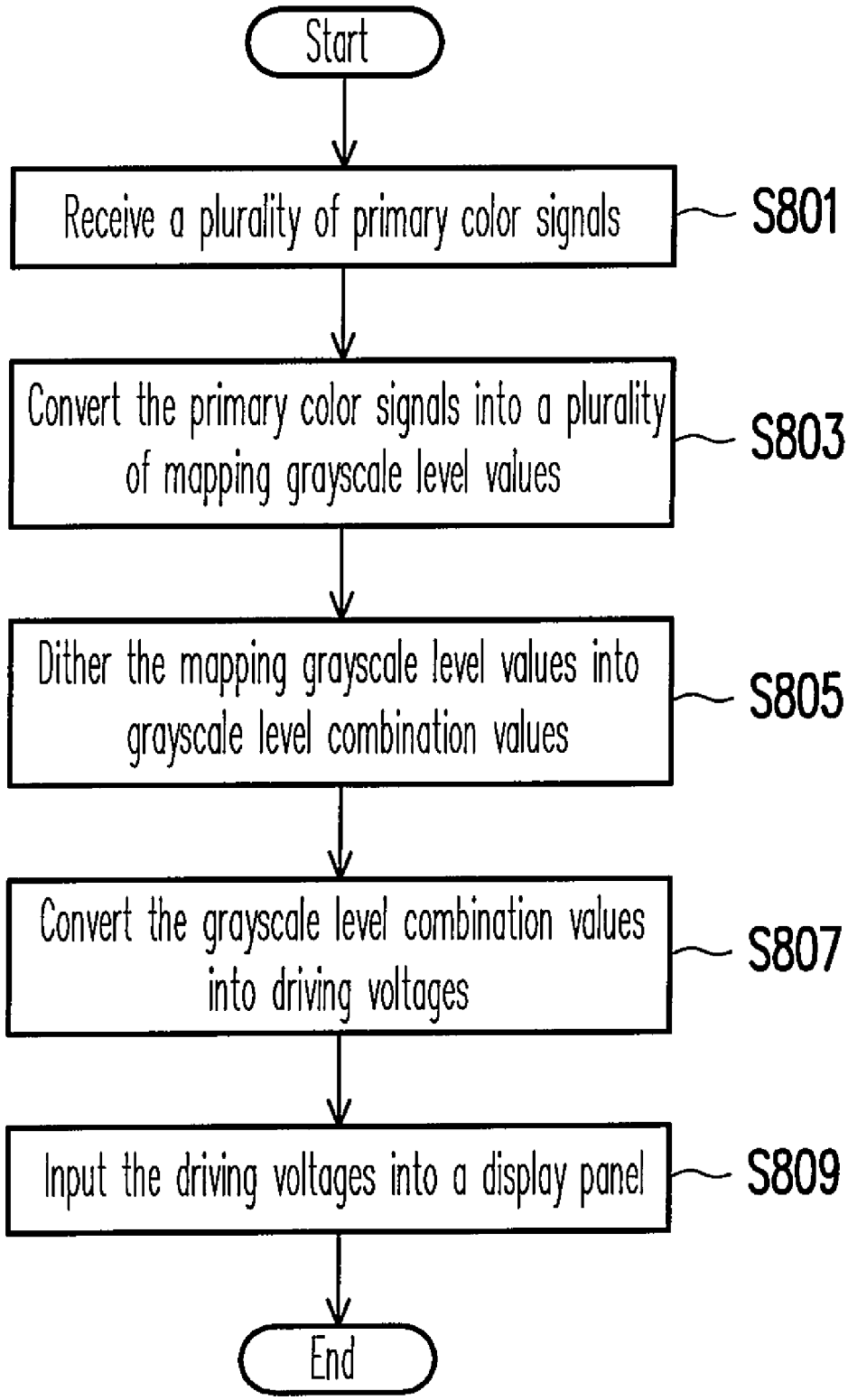
FIG. 8 is a flow chart of a method for driving an OLED display panel according to another embodiment of the present invention.

FIG. 8 is a flow chart of a method for driving an OLED according to another embodiment of the present invention. First, in Step S801, a plurality of primary color signals is received; then, in Step S803, the grayscale levels of the plurality of primary signals are converted into a plurality of mapping grayscale level values corresponding to a single gamma curve according to the grayscale level mapping relation between the single gamma curve and a plurality of primary color gamma curves. Further, in Step S805, the mapping grayscale level values are converted by dithering into a plurality of corresponding grayscale level combination values via a dithering mechanism. Then, in Step S807, the plurality of mapping grayscale level values are converted into a plurality of driving voltages according to the relation between grayscale levels and voltages of the single gamma curve. In Step S809, the plurality of driving voltages is input into a display panel. The driving method of the present embodiment corresponds to that of the foregoing embodiment of the driving device, so the details of the related art have been disclosed in the aforementioned embodiment and they will not be repeated herein.

In summary, the present invention adopts a structure of using a plurality of mapping tables and a dithering mechanism and using a single gamma curve to convert the grayscale levels into corresponding driving voltages, and utilizes the dithering mechanism to improve display quality, instead of requiring a plurality of gamma voltages as in the conventional art, so as to save the cost, reduce the circuit complexity, shorten the research/development time, and facilitate the test and verification of display panels. Furthermore, the mapping table mechanism of the present invention can convert grayscale levels of a primary color gamma curve into correct diving voltages, such that accurate colors can be displayed without deviation. If the present invention is applied to an OLED display panel, the source driver of the OLED display panel can be directly replaced by a source driver of a thin film transistor liquid crystal display panel, thereby reducing the circuit complexity and cost of the OLED display panel.

Though the present invention has been disclosed above by the preferred embodiments, they are not intended to limit the invention. Anybody skilled in the art can make some modifications and variations without departing from the spirit and scope of the invention. Therefore, the protecting range of the invention falls in the appended claims.

What is claimed is:

1. A display panel driving device, comprising:

a plurality of mapping table units, receiving a plurality of primary color signals respectively, and converting grayscale levels of the plurality of primary color signals into a plurality of mapping grayscale level values corresponding to a single gamma curve according to a grayscale level mapping relation between the single gamma curve and a plurality of primary color gamma curves, wherein the plurality of primary color gamma curves at least comprise a red, a green and a blue color gamma curves, the red color gamma curve substantially overlaps the blue color gamma curve, the single gamma curve lies between the red and the green color gamma curves, the single gamma curve overlaps the red, the green and the blue color gamma curves at below a first predetermined grayscale level and only overlaps the red and the blue color gamma curves at above a second predetermined grayscale level, and the second predetermined grayscale level is greater than the first predetermined grayscale level; and a source driver, outputting a plurality of driving voltages corresponding to the mapping grayscale level values into a display panel according to the mapping grayscale level values and the relation between grayscale levels and voltages of the single gamma curve.

2. The display panel driving device as claimed in claim 1, wherein each of the mapping grayscale level values comprises an integral part and a fractional part, and the display panel driving device further comprises a plurality of dithering units respectively electrically connected to the corresponding mapping table units to receive the mapping grayscale level values, so as to perform a dithering mechanism according to the fractional parts to convert the mapping grayscale level values into a plurality of corresponding grayscale level combination values, and input the grayscale level combination values into the source driver, wherein the source driver converts the grayscale level combination values into a plurality combination driving voltages according to the relation between grayscale levels and voltages of the single gamma curve, thereby inputting the combination driving voltages into the display panel.

3. The display panel driving device as claimed in claim 2, wherein the grayscale level combination values are constituted by a plurality of grayscale level values distributed by spatial dithering, and the grayscale level values respectively correspond to a plurality of adjacent pixels in a single frame displayed by the display panel.

4. The display panel driving device as claimed in claim 2, wherein the grayscale level combination values are constituted by a plurality of grayscale level values distributed by temporal dithering, and the grayscale level values respectively correspond to the same pixel of a plurality of frames displayed by the display panel.

5. The display panel driving device as claimed in claim 2, wherein each of the grayscale level combination values is constituted by a plurality of grayscale level values distributed by spatial and temporal dithering, and the grayscale level values respectively correspond to a plurality of adjacent pixels of a plurality of frames displayed by the display panel.

6. The display panel driving device as claimed in claim 1, wherein the primary color signals comprise a red light signal, a green light signal and a blue light signal, and the mapping table units comprise a red light mapping table unit, a green light mapping table unit and a blue light mapping table unit.

7. The display panel driving device as claimed in claim 1, wherein the voltage range of the single gamma curve comprises all driving voltages of the primary color gamma curves.

8. The display panel driving device as claimed in claim 1, wherein the single gamma curve is an increasing function.

9. The display panel driving device as claimed in claim 1, wherein the mapping table units convert the grayscale levels on the primary color gamma curves into the mapping grayscale level values of the same driving voltage on the single gamma curve.

10. A method for driving a display panel, comprising:

receiving a plurality of primary color signals;

converting grayscale levels of the plurality of primary color signals into a plurality of mapping grayscale level values corresponding to a single gamma curve according to a grayscale level mapping relation between the single gamma curve and a plurality of primary color gamma curves, wherein the plurality of primary color gamma curves at least comprise a red, a green and a blue color gamma curves, the red color gamma curve substantially overlaps the blue color gamma curve, the single gamma curve lies between the red and the green color gamma curves, the single gamma curve overlaps the red, the green and the blue color gamma curves at below a first predetermined grayscale level and only overlaps the red and the blue color gamma curves at above a second predetermined grayscale level, and the second predetermined grayscale level is greater than the first predetermined grayscale level;

converting the mapping grayscale level values into a plurality of driving voltages according to the relation between grayscale levels and voltages of the single gamma curve; and inputting the driving voltages into a display panel.

11. The method for driving a display panel as claimed in claim 10, wherein each of the mapping grayscale level values comprises an integral part and a fractional part, and the method for driving the display panel further comprises:

performing a dithering mechanism according to the fractional parts to convert the mapping grayscale level values into a plurality of corresponding grayscale level combination values;

converting the grayscale level combination values into a plurality of driving voltages according to the relation between grayscale levels and voltages of the single gamma curve; and inputting the driving voltages into the display panel.

12. The method for driving a display panel as claimed in claim 11, wherein the grayscale level combination values are constituted by a plurality of grayscale level values distributed by spatial dithering, and the grayscale level values respectively correspond to a plurality of adjacent pixels in a single frame displayed by the display panel.

13. The method for driving a display panel as claimed in claim 11, wherein the grayscale level combination values are constituted by a plurality of grayscale level values distributed by temporal dithering, and the grayscale level values respectively correspond to the same pixel in a plurality of frames displayed by the display panel.

14. The method for driving a display panel as claimed in claim 11, wherein the grayscale level combination values are constituted by a plurality of grayscale level values distributed by spatial and temporal dithering, and the grayscale level values respectively correspond to a plurality of adjacent pixels in a plurality of frames displayed by the display panel.

15. The method for driving a display panel as claimed in claim 10, wherein the primary color signals comprise a red light signal, a green light signal and a blue light signal, and the primary color gamma curves comprise a red light gamma curve, a green light gamma curve and a blue light gamma curve.

16. The method for driving a display panel as claimed in claim 10, wherein the voltage range of the single gamma curve comprises all driving voltages of the primary color gamma curves.

17. The method for driving a display panel as claimed in claim 10, wherein the single gamma curve is an increasing function.

18. The method for driving a display panel as claimed in claim 10, further comprising respectively converting the grayscale levels on the primary color gamma curves into the mapping grayscale level values of the same driving voltage on the single gamma curve.

* * * * *